US006350228B1

(12) United States Patent
Richards et al.

(10) Patent No.: US 6,350,228 B1
(45) Date of Patent: Feb. 26, 2002

(54) INFANT CARE APPARATUS WITH PROTECTIVE SOUND AND LIGHT

(75) Inventors: Andrew H. Richards, Westminster; Christopher A. Dykes, Columbia; Steve S. Tourison, Laurel, all of MD (US)

(73) Assignee: Datex-Ohmeda, Inc., Madison, WI (US)

( * ) Notice: Subject to any disclaimer, the term of this patent is extended or adjusted under 35 U.S.C. 154(b) by 0 days.

(21) Appl. No.: 09/503,070

(22) Filed: Feb. 12, 2000

Related U.S. Application Data

(60) Provisional application No. 60/170,271, filed on Dec. 11, 1999.

(51) Int. Cl.[7] ..... A61G 11/00
(52) U.S. Cl. ..... 600/22
(58) Field of Search ..... 600/22, 484, 529, 600/549

(56) References Cited

U.S. PATENT DOCUMENTS 3,802,417 A * 4/1974 Lang ..... 600/529
4,331,161 A * 5/1982 Patel ..... 600/549
4,738,264 A * 4/1988 Orlando ..... 600/484
4,936,824 A 6/1990 Koch et al.
5,474,517 A 12/1995 Falk et al.
5,759,149 A * 6/1998 Goldberg et al. ..... 600/22

* cited by examiner

*Primary Examiner*—Eric F. Winakur
*Assistant Examiner*—Nikita R Veniaminov
(74) *Attorney, Agent, or Firm*—Roger M. Rathbun

(57) ABSTRACT

An infant care apparatus is provided that includes a support for underlying the infant within the apparatus for providing care to that infant. The apparatus has an alarm system that triggers upon the occurrence of some event indicating that a particular parameter or condition of the apparatus or infant is outside the prescribed limits or other fault condition. The alarm system thus provides a signal indicative of that alarm condition to activate a means of warning the caregiver of the existence of the alarm condition. A sound producing device and/or light producing device receives the signal produced by the audible sound or light producing device to alert the caregiver of the alarm condition. The sound producing device and the light producing device are positioned on the apparatus such that there is a sound barrier and light barrier, respectively, between the particular device and the infant so that the infant is protected from being startled, and thus stressed, by the alarm audible sound or light activation.

8 Claims, 3 Drawing Sheets

INFANT CARE APPARATUS WITH PROTECTIVE SOUND AND LIGHT

RELATED APPLICATIONS

This application is based upon Provisional Patent Application Serial No. 60/170,271 filed Dec. 11, 1999.

BACKGROUND

The present invention relates to an infant care apparatus and, more particularly, to an apparatus for providing facilities for the care of the infant and having an audible and/or light producing alarm device physically isolated from the infant.

There are, of course, many devices or apparatus for the care of an infant and, among such differing apparatus, there are infant warmers that are basically planar surfaces on which the infant is positioned and which planar surfaces generally include side guards to keep the infant safely within the confines of the apparatus. A radiant or other type of heater is provided overhead that directs infrared energy toward the infant resting on the planar surface to warm that infant.

There are also infant incubators and which are more confined enclosures that contain the infant within an enclosed controlled atmosphere that provides heat to the infant and also may provide control of humidity in the enclosed environment. Such incubators maintain the infant for long periods of time and generally include handholes to access the infant to carry out interventions on the infant and also have larger doors that can be opened to access the infant or to insert or remove the infant to and from the incubator.

With either type of infant care apparatus as well as potentially other types of apparatus that may provide a means of care to an infant, the apparatus generally includes an alarm system to provide notice to the caregiver that some condition or parameter is outside a prescribed limit i.e. that some function of the apparatus is improperly functioning or the infant is experiencing some problem. Accordingly, such alarms can be indicative of any number of different conditions of the apparatus or the infant.

In the case of an alarm system, when an alarm condition is sensed, the alarm system sends a signal to a sound producing device, such as a speaker, and/or to a light producing device so that the caregiver can have an audible or visible indication that the alarm condition has occurred and the alarm triggered. Thus, the caregiver can recognize the triggering of the alarm and take whatever action is necessary to alleviate the alarm condition.

One difficulty with current alarm systems, however, is that an infant in the care of such infant care apparatus is generally in a fragile condition and is quickly startled by stimuli from the surrounding environment. Such startling events, however, are not conducive to the well being of the infant and it would be more preferable for the infant to be maintained in a quiet, undisturbed environment. In effect, it is important for the sound or light indicative of an alarm condition to be prominent in order to capture the attention of the attending personnel that may be occupied with numerous duties, yet that same attention capturing feature is undesirable if it reaches the infant and creates stress in that infant.

Thus, in the event of an alarm activation, the infant can be startled by the activation of an audible alarm if that sound producing device is near the infant and the sound is directly communicated to that infant. Similarly, the infant can be startled by a light producing device indicative of an alarm if the light can be seen by that infant. Unfortunately, current alarm signaling devices, including sound producing and light producing devices, are normally positioned relatively high up on the infant care apparatus, generally near the control module for that apparatus and the location is such that any activation of the light or sound producing devices startles the infant when resting within the normal infant compartment of the apparatus.

Thus, it would be desirable to have an infant care apparatus having a light and/or sound producing device to indicate the occurrence of an alarm condition without, at the same time, causing stress in the infant by startling that infant.

SUMMARY OF THE INVENTION

Accordingly, the present invention relates to an infant care apparatus that has a base and a frame extending upwardly from the base and which has an infant platform extending outwardly, preferably in cantilever manner from the frame. The infant platform has a flat, planar surface to provide a support for positioning the infant. Various alarms are provided to alert the caregiver of the existence of certain conditions, among them are malfunctions of the infant care apparatus, certain conditions of the infant or may be any number of other functions or parameters that are outside certain defined limits allowed by the infant care apparatus and its alarm system.

In the operation and function of the alarm system, there are, of course, alarm indicating devices which include an audible sound producing device that responds to a signal from the alarm system when an alarm condition has been sensed and the alarm triggered. The sound producing device, typically a speaker, thus emits a sound to alert the attending personnel of the existence of the alarm condition to allow the personnel to assess the situation, determine the type and cause of the alarm and to take the appropriate action. In addition, or alternatively, there may be a light producing device that also responds to a signal from the alarm system of the infant care apparatus, and which produces a light to alert the attending personnel of that alarm condition. In either case, the particular alarm signal may be coded so as to make the determination of the cause of the alarm easier for the personnel to recognize.

In carrying out the present invention, however, the sound and the light producing devices are shielded from direct communication with the infant positioned within the infant compartment, that is, the sound producing device is located on the infant care apparatus in such a location that there is a sound shielding or audible sound barrier interposed between the sound producing device and the infant so that the effect of the sound is muted or blocked altogether to prevent that sound from startling the infant.

In addition, as a further preventative measure to the startling of the infant by an audible alarm, the sound producing device is oriented in a direction such that the sound is directed away from the infant and not towards the infant, that is, the sound producing device is directed so as to maximize the sound toward the caregiver that needs to be aware of an alarm condition while, at the same time, the sound is directed away from the infant.

In similar fashion, the light producing device is also located on the infant care apparatus such that there is a light barrier located between the infant and the light producing device to prevent that light indicative of an alarm condition, and which may be blinking, to create an attention getting signal, from reaching the eyes of the infant and cause the infant to be startled or over stimulated.

In the preferred embodiment, the sound producing device is affixed to the base of the infant care apparatus andthus is beneath the infant platform such that the infant platform itself is the sound barrier to shield the infant from the sound emitted from the sound producing device and the orientation is such that that sound is directed away from the location oft he infant.

These and other features and advantages of the present invention will become more readily apparent during the following detailed description taken in conjunction with the drawings herein.

DETAILED DESCRIPTION OF THE INVENTION

Figure 1:
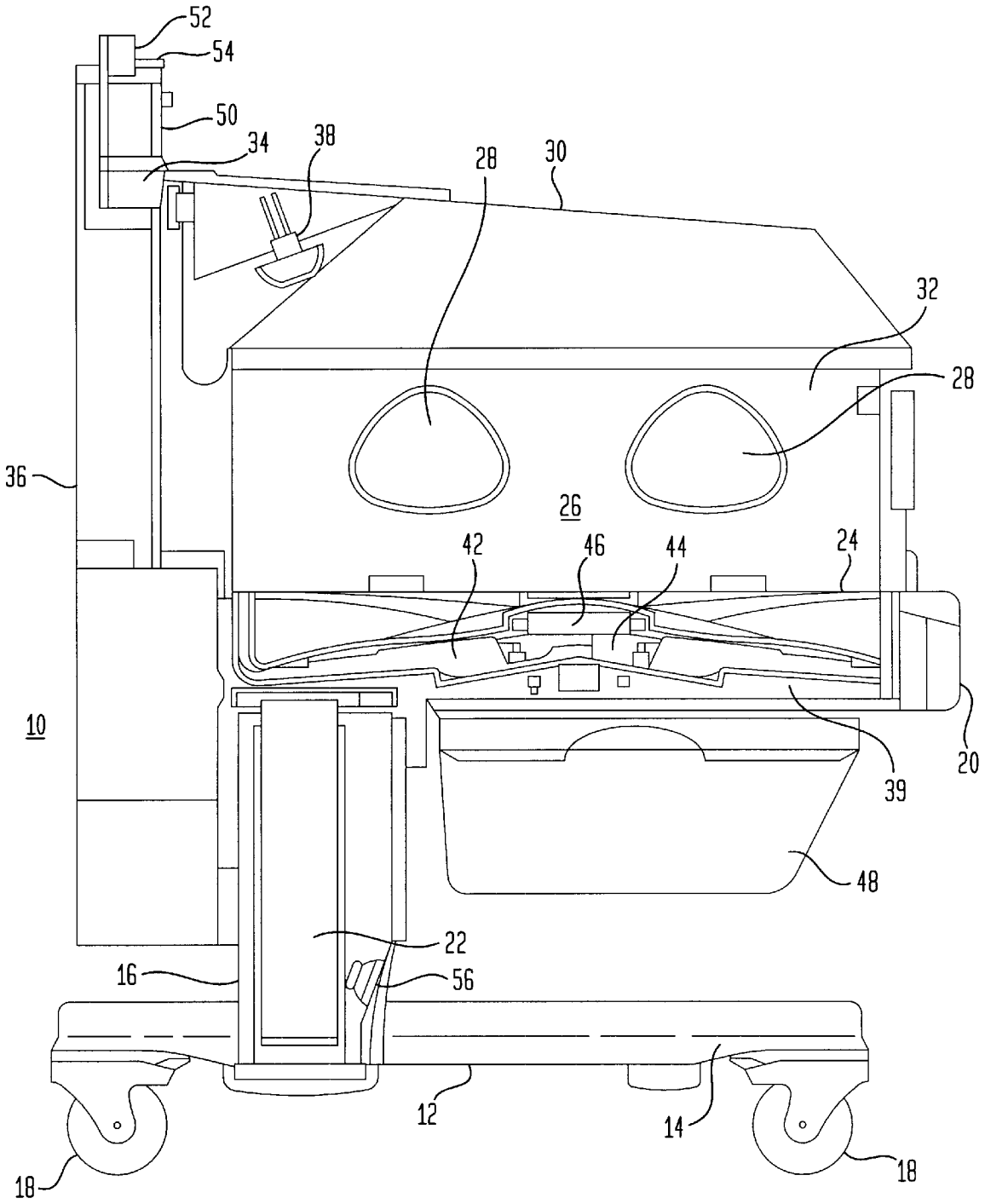
FIG. 1 is a side view of an infant care apparatus incorporating the present invention.
Figure 2:
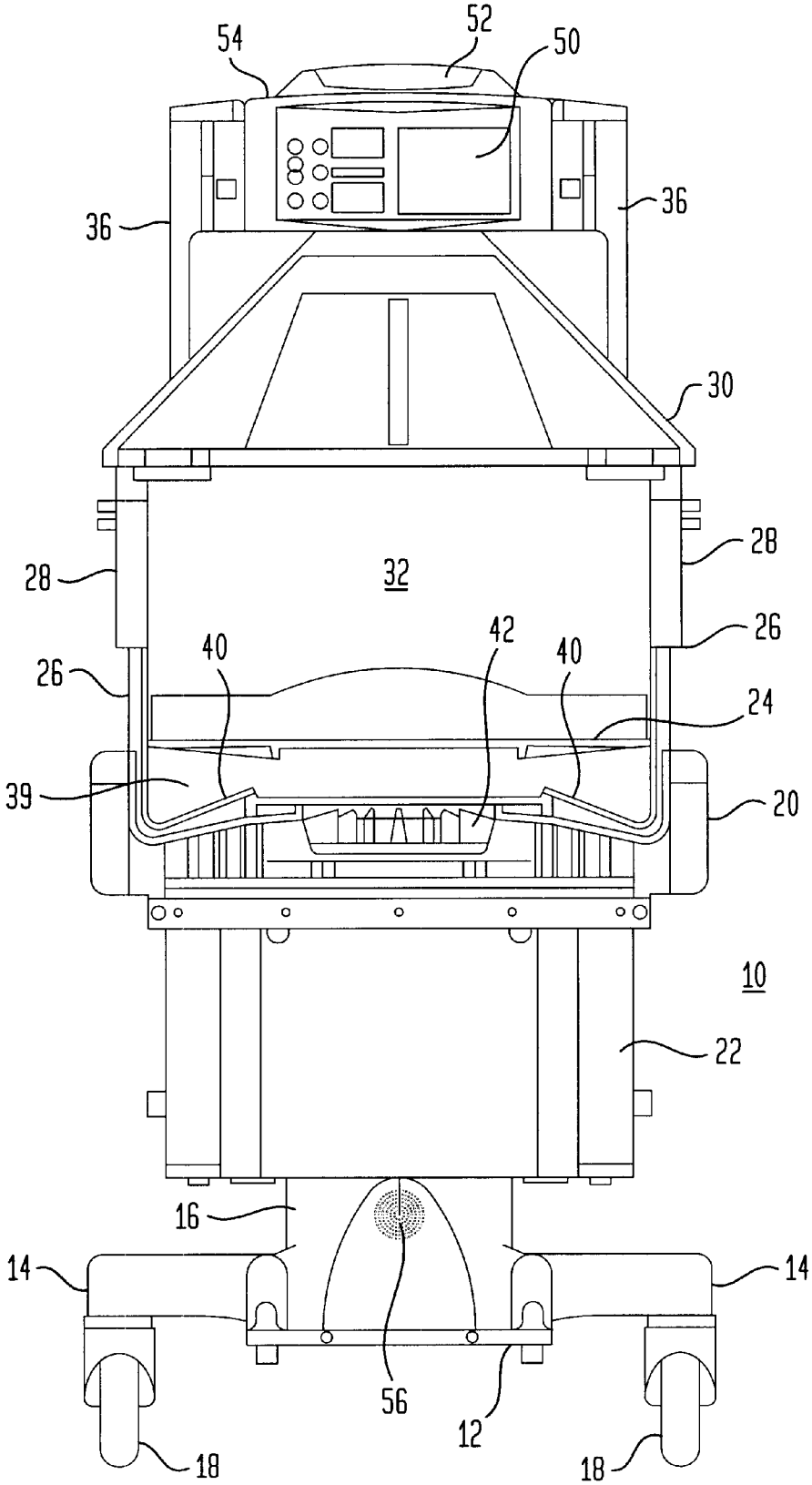
FIG. 2 is a end view of the infant care apparatus of FIG. 1.
Figure 3:
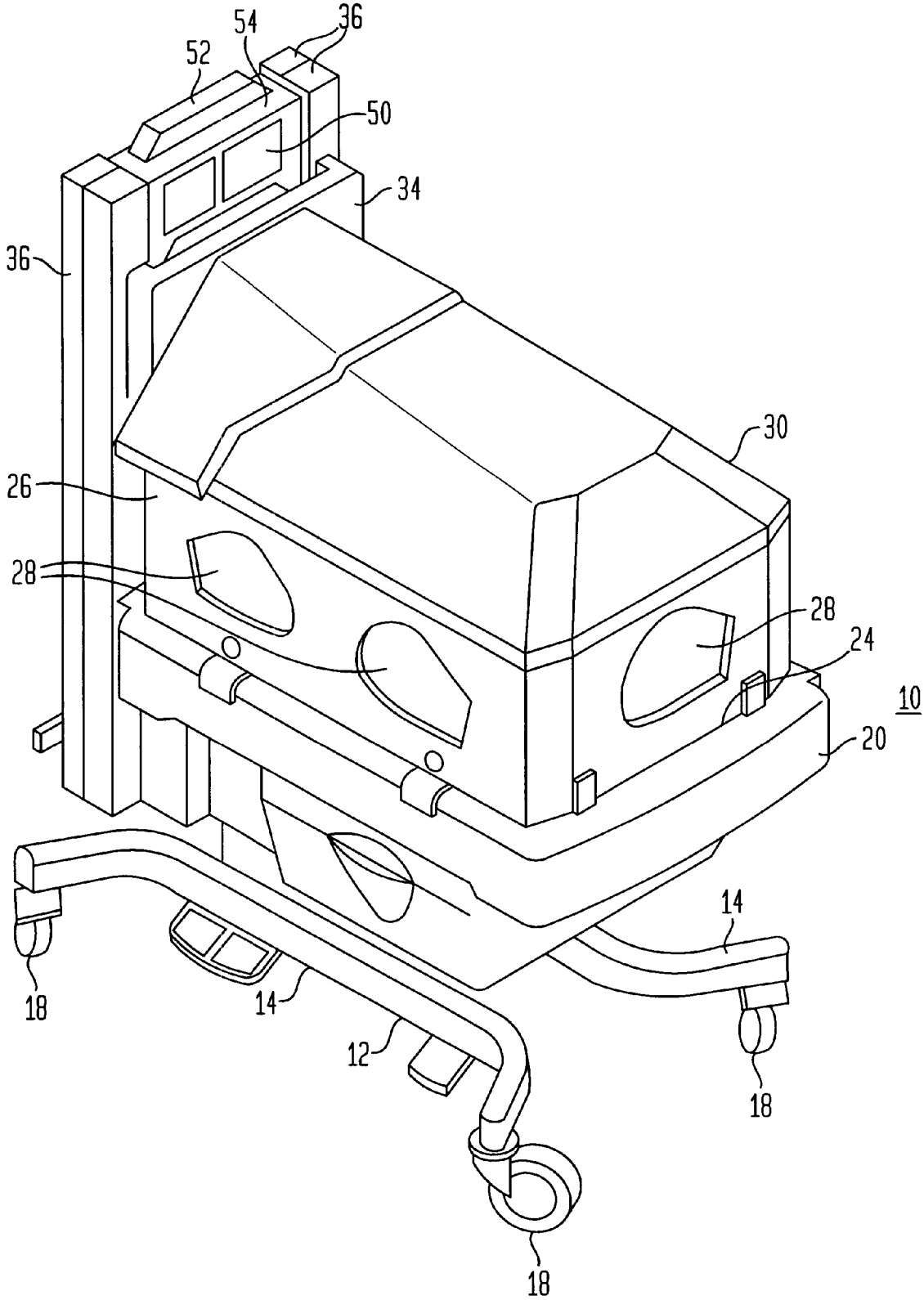
FIG. 3 is a perspective view of the infant care apparatus of FIGS. 1 and 2.

Referring now to FIG. 1, there is shown a side view of an infant care apparatus 10 constructed so as to use the present invention. Referring also to FIGS. 2 and 3, there are shown, respectively, an end view of an infant care apparatus 10 and a perspective view of the infant care apparatus of FIGS. 1 and 2. As will be seen, the present description will be with reference specifically to an infant incubator as the infant care apparatus, however, it will become obvious that the present invention can readily be used with other infant care apparatus such as an infant warmer as shown and described in U.S. Pat. No. 5,474,517 of Falk et al.

Thus, in the Figs, the infant warming apparatus 10 includes a base 12 comprising a pair of U-shaped members 14 that are joined together and which provide support for a stationary vertical base member 16. Wheels 18 may also be provide for ready movement of the infant care apparatus 10.

An infant platform 20 is provided and which supports an infant in the infant care apparatus 10 and the infant platform 20 may be mounted in cantilever manner to a movable vertical base member 22 in a manner such that the user can adjust the height of the infant platform 20 by raising and lowering the movable vertical base member 22 with respect to the stationary vertical base member 16 to the preferred height by the user. The infant platform 20 includes a flat, planar surfaces 24 that actual underlies the infant when positioned with the infant care apparatus 10.

Extending upwardly around the periphery of the infant platform 20 are a plurality of walls 26, normally of a transparent plastic material and which surround the flat planar surface 24 to enclose the infant on the surface 24. As can be seen, the walls 26 can have handholes 28 to enable the caregiver to reach the infant, however, if even more access is required to the infant, at least the side walls 26 can be dropped downwardly to open fully for complete access to the infant to carry out procedures on the infant or for introducing and removing the infant from the infant care apparatus 10.

A hood 30, when in the position as shown in the Figs. the upper peripheral edges of the walls 26 to enclose therein an infant compartment 32 that provides a controlled environment where heat and humidity can be controlled to aid in the development and well being of the infant. The hood 30 may of a conventional design, however, in the embodiment as shown, the hood 30 can be raised and lowered vertically to cover and uncover the infant compartment 32. The raising and lowering mechanism is not part of the present invention, however a mechanism is described in detail in copending U.S. patent application Ser. No. 09/316,506 filed May 21, 1999 and entitled Lift Mechanism For Infant Care Apparatus Canopy and the disclosure of which is incorporated herein by reference.

In general, and which is sufficient for purposes of the present disclosure, the hood 30 is affixed to a movable vertical frame member 34 that moves with respect to, and interfits with stationary vertical frame members 36 and a lifting mechanism is used to move the movable vertical frame members 34 and the hood 30 upwardly and downwardly with respect to the stationary vertical frame members 36.

A radiant heater 38 can also be included for providing heat to the infant when the hood 30 is in its uppermost position and thus the infant care apparatus 10 can be operated in the manner of an infant warmer, one of which is shown and described in the aforementioned U.S. Pat. No. 5,474,517 of Falk et al or as an incubator in the configured position as shown in the present Figures.

A heating and air moving compartment 39 is located within the infant platform 20 beneath the flat, planar surface 24 on which the infant is positioned and within the heating and air moving compartment 39 there is located the various ducting and convective heating equipment that directs the air up to within the infant compartment 32 and to receive the air from the infant compartment 30 for recirculation. Thus, within the heating and air moving compartment, there is a heater 42 and a fan 44 operable by a motor 46 and which heats the air to be introduced into the infant compartment 32 to provide the warmth to the infant. The heating and air moving compartment 39 can be conventional and may be similar to the apparatus shown and described in U.S. Pat. No. 4,936,824 of Koch et al.

Another convenient feature includes a drawer 48 positioned beneath the infant platform 20 and which can be used to retain supplies or other devices needed to carry out some operation or procedure on the infant.

A control module 50 is conveniently positioned intermediate the vertical stationary frame members 36 and may include displays of various monitored parameters as well as include the various controls for operation of the functions of the infant care apparatus 10. The control module 50 may also contain the alarm functions that may be set by the user or may be established and preset by the manufacturer. Such alarm circuits are, themselves, quite conventional and are included on almost all infant care equipment currently on the market.

Accordingly, in the current alarm circuits, an alarm is triggered by the occurrence of some parameter or event that is outside of the predetermined limits for that function and thus, an alarm signal is provided indicative of that particular fault or undesirable condition. That alarm signal is therefore provided upon the occurrence of the particular alarm that is triggered and the signal is transmitted to a signaling device to quickly get the attention of the caregiver.

In the present invention, there is a light producing device that receives the signal indicative of an active alarm and converts that signal into a visually perceived notice to the caregiver that some alarm has been activated. As shown in FIGS. 1 and 3, in particular, the light producing device may be a plastic lens 52 within which is a light bulb. The position of the light producing device is prominent in the infant care apparatus 10 to fully apprise the care giver promptly and positively of the occurrence of the alarm condition, however, as seen in the Figs., the upper surface 54 of the control module 50 extends forwardly of the rearwardly displaced plastic lens 50 and blocks that plastic lens 50 from being perceived by an infant positioned within the infant compartment 32.

Thus, the position of the light producing device is deliberately positioned located so as to fully inform the caregiver of the presence of a particular alarm condition, on the other hand, the upper surface 54 of the control module 50 creates a barrier to the light radiation from that light producing device from reaching the infant so that the infant is not startled or stressed by the operation of the light producing device. In the embodiment shown, the barrier is created by the upper surface 54 of the control module 50 as an example, however other barriers may certainly be used, it only being important that the light radiation from the light producing device be blocked by some by some barrier from being seen by the infant when positioned within the infant compartment 32.

The same signal from an alarm circuit can also be used trigger and cause an audible sound to alert the care giver of the presence of an alarm condition and a sound producing device can be used to achieve that result. Thus, as can be seen in FIGS. 1 and 2, there is a speaker 56 located in the base 12 of the infant care apparatus 10 to alert the caregiver of the existence of the alarm condition and, as can be seen, the speaker 54 is positioned on the apparatus so as to be in a low position, beneath the infant platform 20.

As such, therefore, when the speaker 56 is activated to produce a sound indicative of an alarm, the sound is blocked by the barrier created by the infant platform 20 as well as the heating and air moving compartment 39 and all of the equipment contained therein. The sound emitted from the sound producing device is thus shielded from directly reaching the infant when that infant is positioned within the infant compartment 32 and the infant is spared the high stress and startling that could be caused if the infant were subjected to the sound of the alarm. The alarm sound can therefore be readily communicated to the caregiver in such a fashion as to fully alert the caregiver without causing a stressful reaction in the infant.

In addition, as can be seen, the location of the speaker 56 is in the base 12 such the direction of the sound produced is directed outwardly from the infant care apparatus 10 away from the infant but toward the caregiver that would need to be aware of any such audible alarm.

Those skilled in the art will readily recognize numerous adaptations and modifications which can be made to the infant care apparatus of the present invention which will result in an improved control system, yet all of which will fall within the scope and spirit of the present invention as defined in the following claims. Accordingly, the invention is to be limited only by the following claims and their equivalents.

We claim:

1. An infant care apparatus, said apparatus comprising a base having a surface on which an infant is adapted to be positioned, said apparatus having an alarm system adapted to produce an alarm signal when an alarm condition has been sensed, an audible sound producing device responsive to said signal from said alarm system to produce an audible sound, said audible sound producing device being located beneath said surface, said surface thereby forming a barrier positioned intermediate an infant when positioned on said surface and said audible sound producing device to prevent the direct transmission of sound from said audible sound producing device to the infant when positioned on said surface.

2. An infant care apparatus as defined in claim 1 wherein said audible sound producing device produces a sound directed away from an infant when positioned on said surface.

3. An infant care apparatus as defined in claim 1 wherein said infant care apparatus further includes a light producing device to produce a light responsive to the signal from said alarm system.

4. An infant care apparatus as defined in claim 3 wherein said apparatus includes a light barrier intermediate an infant when positioned on said surface and said light producing device to block the light from said light producing device from an infant when positioned on said surface.

5. An infant care apparatus, said infant care apparatus comprising a base, an infant platform supported on said base, a plurality of walls extending upwardly from said infant platform and having a hood to enclose therein an infant compartment adapted to enclose an infant therein, a heating and air moving compartment located within said infant platform and adapted to introduce heated air into said infant compartment, said infant care apparatus further having an alarm system adapted to produce an alarm signal when an alarm condition has been sensed by said alarm system, an audible sound producing device responsive to said signal from said alarm system to produce an audible sound, said sound producing device affixed to said base below said infant platform whereby said infant platform isolates an infant when enclosed within said infant compartment from the direct transmission of sound from said sound producing device.

6. An infant care apparatus as defined in claim 5 wherein said sound producing device is a speaker mounted in said base.

7. An infant care apparatus as defined in claim 6 wherein said speaker directs sound away from an infant when located within said infant compartment.

8. An infant care apparatus as defined in claim 5 wherein said apparatus includes a light producing device activated by said alarm signal, and wherein said light producing device is affixed to said frame, said apparatus having a light barrier located between said light producing device and an infant when enclosed within said infant compartment.

* * * * *